United States Patent [19]

Ogilvie et al.

[11] Patent Number: 4,856,385

[45] Date of Patent: Aug. 15, 1989

[54] SQUEEZE MOTION TO ROTARY MOTION TILT HEAD DRIVER

[75] Inventors: James W. Ogilvie, Edina, Minn.; Frank R. Ogilvie, Leavenworth, Wash.

[73] Assignee: Reagents of the University of Minnesota, Minneapolis, Minn.

[21] Appl. No.: 170,288

[22] Filed: Mar. 18, 1988

[51] Int. Cl.[4] ..... B25B 13/46

[52] U.S. Cl. ..... 81/57.39; 81/57.43

[58] Field of Search ..... 81/57.26–57.29, 81/57.39, 57.43, 57.45, 57.46, 58.1

[56] References Cited

U.S. PATENT DOCUMENTS

| | | | |
|---|---|---|---|
| 3,132,549 | 5/1964 | Lee | 81/57.29 |
| 3,756,090 | 9/1923 | Mella et al. | 81/57.39 X |
| 3,948,120 | 4/1976 | Hancock | 81/165 |
| 4,099,430 | 7/1978 | Stodola | 81/58.1 |
| 4,296,654 | 10/1981 | Mercer | 81/57.26 |
| 4,327,611 | 5/1982 | Catanese et al. | 81/177.9 |
| 4,463,632 | 8/1984 | Parke | 81/177.9 |
| 4,488,461 | 12/1984 | Hurtig | 81/98 |
| 4,513,642 | 4/1985 | Castner et al. | 81/52 |
| 4,524,650 | 6/1985 | Marks | 81/57 |
| 4,636,217 | 1/1987 | Ogilvie et al. | 623/17 |
| 4,656,894 | 4/1987 | Goetz | 81/57.43 |
| 4,739,838 | 4/1988 | Marks | 173/170 |

*Primary Examiner*—James G. Smith

*Attorney, Agent, or Firm*—Kinney & Lange

[57] ABSTRACT

A driving tool having a tiltable head lockable into a plurality of positions for imparting rotating motion to an output device as the result of squeezing two handle members.

1 Claim, 3 Drawing Sheets

SQUEEZE MOTION TO ROTARY MOTION TILT HEAD DRIVER

BACKGROUND OF THE INVENTION

1. Field of the Invention

The present invention relates to mechanical drivers in general and, more particularly, to a tilt head driver in which squeeze type motion is converted to rotary motion with a novel cable drive mechanism.

2. Description of the Prior Art

In the prior art, all sorts of tools have been devised for driving screws and bolts. Many of these have rather novel arrangements for converting one kind of motion to another but none of them, to applicants' knowledge, are able to convert squeeze type motion into rotary motion on a head which can be tilted to a plurality of positions so as to provide access into difficult areas.

For example, U.S. Pat. No. 3,948,120 discloses a wrench head with a fixed jaw and a sliding jaw. The handle is separate and is attached to the head through a square hole. The handle may be ratcheted. U.S. Pat. No. 4,296,654 discloses a wrench in which a gear drive is used to transmit power to the output. The input handle may be rotated or pumped in a plane parallel to or perpendicular to the output axis to impart the desired rotation at the output. U.S. Pat. No. 4,327,611 discloses a double ended wrench with pivoted ends and a sleeve which moves to i) leave both heads free or ii) lock either end. U.S. Pat. No. 4,463,632 discloses a device for temporarily holding a tool at a particular angle and then, when desired, locking it in that position. U.S. Pat. No. 4,488,461 discloses a continuously adjustable wrench. U.S. Pat. No. 4,513,642 discloses a wrench with a head rotatable with respect to the handle so that the angular relationship is variable. Retaining means hold the angle during application of force. Wiggling the handle allows the head to turn.

None of the prior art allows squeezing motion to be converted into rotary motion and where the head itself must be adjustable to various positions to accommodate reading difficult access areas.

SUMMARY OF THE INVENTION

The present invention provides a tool which converts squeeze motion to rotary motion and with a head tiltable to various anges to accommodate access to sites. A novel cable drive mechanism is employed and one-way turning is provided so that continuous resetting of the tool in the socket to be driven is not required. Such action is particularly desirable in situations where many rotations of the head may be required, and removal and reinsertion of the head into the screw slot on each turn is undesirable.

While the present invention has utility in many fields, it finds specific utility in surgical fieds where, for example, it is desired to fasten a prosthetic implant into or onto adjacent bones.

For example, in out U.S. Pat. No. 4,636,217, assigned to the assignee of the present invention, a spinal implant prosthetic insert for implementation into a void in the spinal column in place of a diseased or injured vertabra is disclosed. The insert is rigidly fixed in place with bone screws that will screw into the adjacent upper and lower vertabrae after the insert has been positioned in place. The driving shafts which cause the screws to move into the upper and lower bones are often awkward to reach with standard driving tools. Furthermore, the drive mechanism between the driving shafts and the screws requires a large number of turns before the screws are fully in place. With standard tools, this can be difficult and rather exhausting.

With the present invention, the screws or other rotatable fasteners can be accessed quite easily by tilting the head of the present invention to the proper position and inserting the driver into or around the fastener. After the driver has been properly connected to the fastener, it only takes further squeezing motions of the handles to provide one-way rotary motion of the driver. Thus, in the surgical use discussed above, the screws may be set in the upper and lower bones with simple squeezing motions much more easily than has been permitted with the prior art devices. It should be understood that while the present invention finds particular applicability to the surgical procedures outlined above, the invention is not to be limited to surgical applications since, as will be seen by those skilled in the art, many other applications of the tool are possible.

DETAILED DESCRIPTION OF THE PREFERRED EMBODIMENTS

Figure 1:
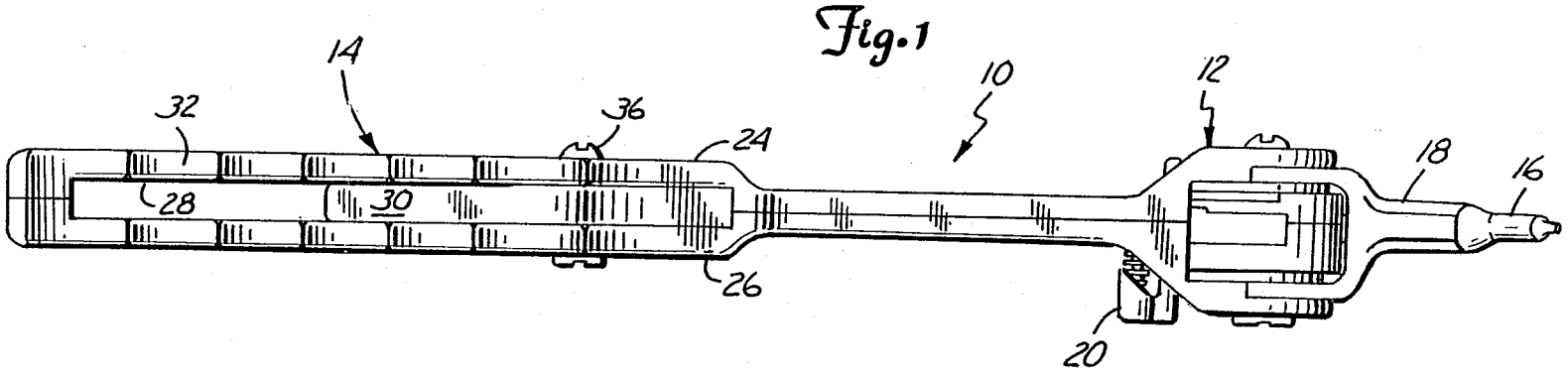
FIG. 1 is a top view of the driver of the present invention.
Figure 2:
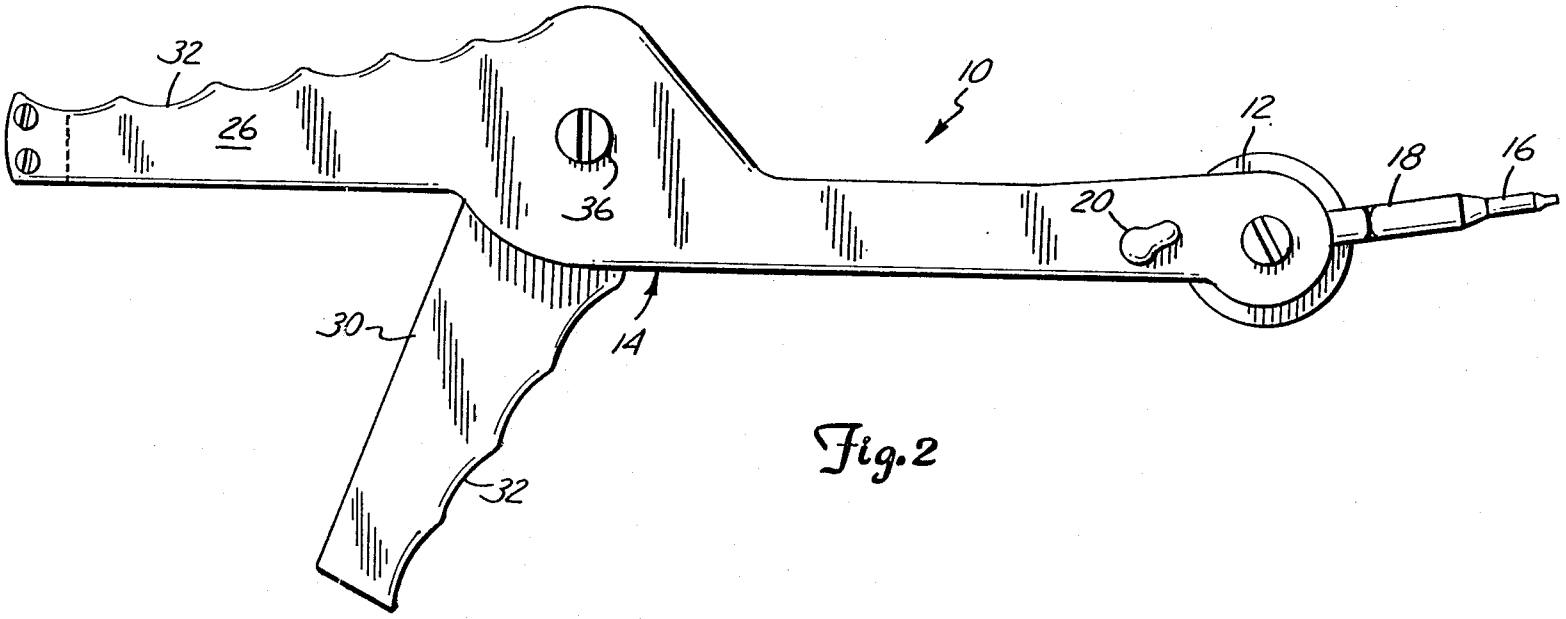
FIG. 2 is a side view of the driver of FIG. 1.

FIGS. 1 and 2 show a top view and side view of the overall appearance of the driver 10 of the present invention. It is seen that the driver comprises a head portion 12 and a handle portion 14. The head portion 12 includes a drive member 16 at the far end thereof which drive member may have an end configured so as to fit the screw or other fastener configuration with which it is desired to be used. Drive member 16 may be screw-threaded onto the shaft 18 to which it is attached by a screw thread of opposite inclination to the direction of drive so as to prevent loosening of drive member 16 during use. Drive member 16 may be replaced with other forms of heads such as Philips head, flat or Allen wrench type heads to accommodate various drive configurations.

Figure 5:
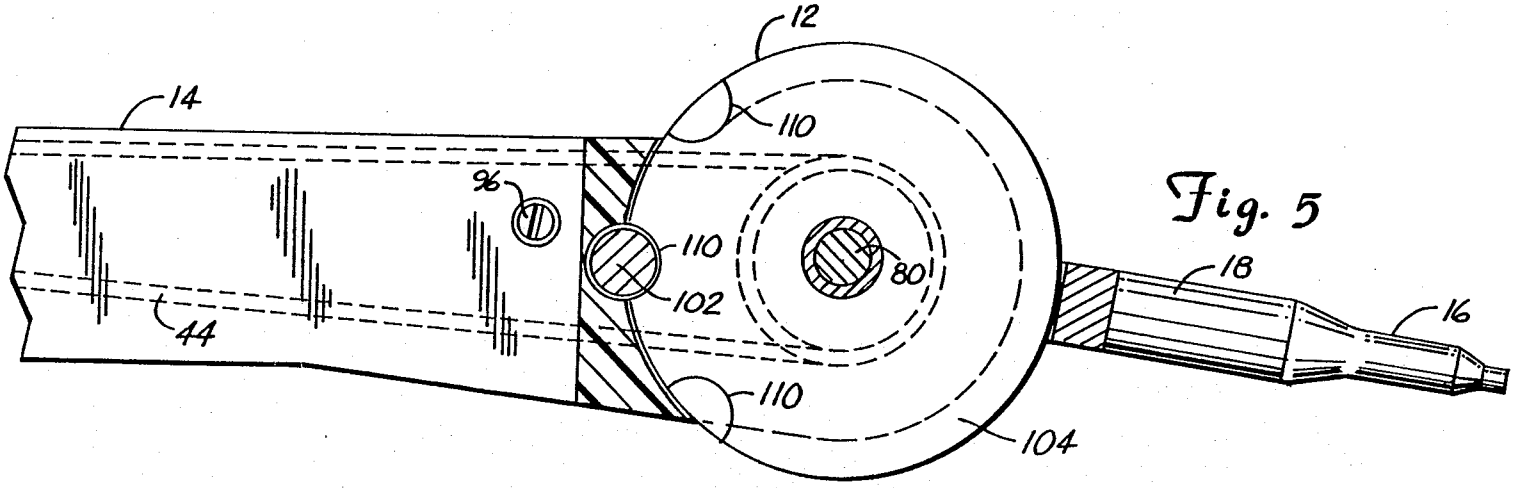
FIG. 5 is a side view of FIG. 4 showing the tilt head locking arrangement of the present invention.

Head 12 also includes a spring biased member 20 which may be pushed upwardly in FIG. 1 so as to allow the steering of a shaft housing 18 and drive member 16 to any of a plurality of desired angles and thereafter the spring will bias the member 20 back to a locking position. This mechanism will be described more completely in connection with FIG. 5.

Drive member 16, shaft housing 18 and bias member 20 are preferably made of metal and, for surgical applications, are preferably made of 316 L low carbon stainless steel, as are the other metal parts described hereinafter.

Handle 14, which may be made of thick white nylon or other suitable material, is seen in FIGS. 1 and 2 to comprise three separate parts. In FIG. 1, an upper handle member 24 and a lower handle member 26 are shaped so as to provide a central opening 28 into which a movable handle member 30 is positioned. It is seen that both upper and lower handle members 24 and 26 are shaped at the left end in fluted fashion, as at 32, so as to provide hand grips for the operator.

Movable member 30 is joined into the opening 28 of the upper and lower housing members 24 and 26 by a suitable connector such as a bolt 36, as will be better described in connection with FIG. 3. Movable handle member 30 will rotate about the axis of bolt 36 is scissor-like fashion with respect to the upper and lower housing member 24 and 26 and into and out of the aperture 28. Member 30 is spring biased by apparatus best shown in FIG. 3 so as to automatically return to the position shown in FIG. 2 after each time it is squeezed together.

By a novel drive mechanism, to be described in connection with FIGS. 3 and 4, squeezing motion of movable member 30 with respect to upper and lower housing members 24 and 26 operates to cause clockwise driving motion to the member 16 and thus enable the rotation of the screws of the above described prosthetic insert to drive them into the upper and lower bones as desired.

Figure 3:
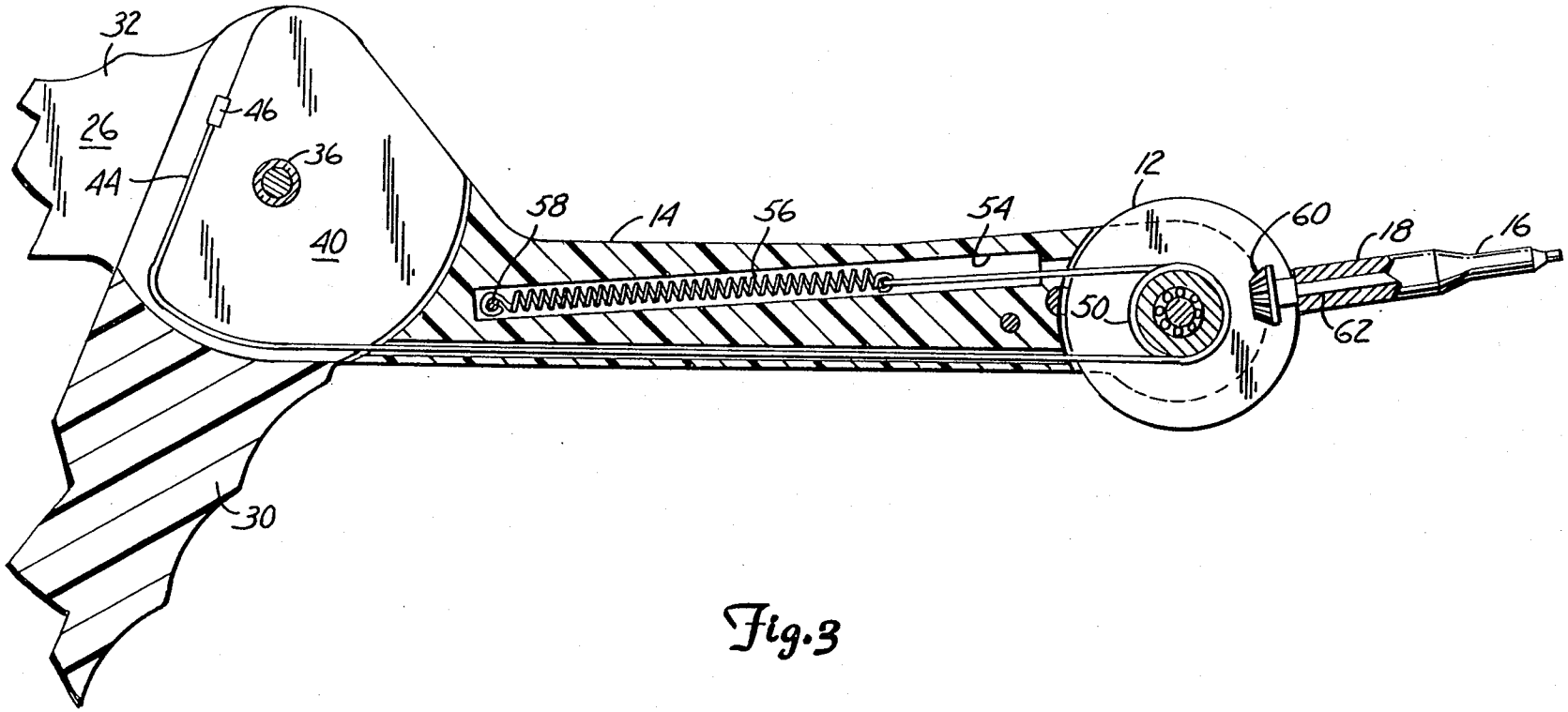
FIG. 3 is a partial side view of the driver cut away to show the cable driving mechanism.

Turning now to FIG. 3, a cutaway section of a portion of the handle 14 and the head 12 is shown. As seen in FIG. 3, the movable handle 30, shown in cross section, is attached to a cam shaped member 40 which may also be made of stainless steel.

Figure 4:
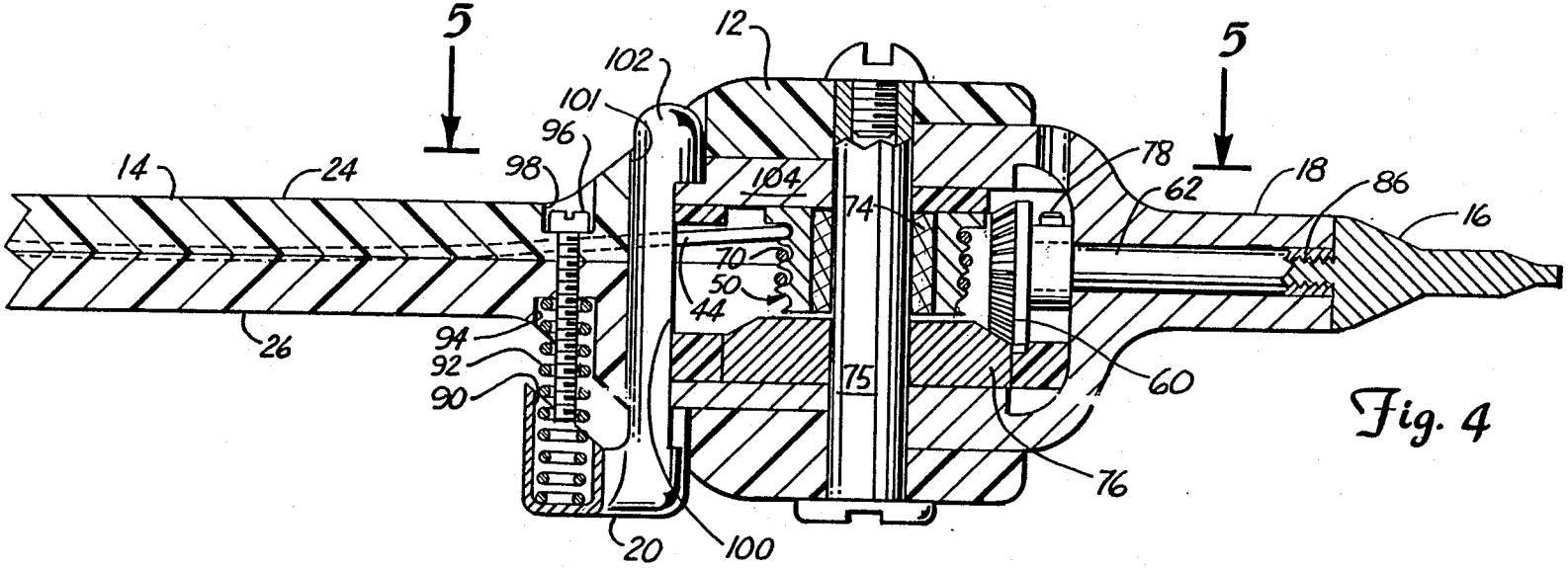
FIG. 4 is a cutaway view of the drive head.

A cable 44 is shown attached to member 40 at a position 46 and then winds around the cam shaped surface of member 40 and through the handle 14 where it is wrapped around a central drum 50 in head 12, as will be better seen in connection with FIG. 4.

After being wound around drum 50, cable 44 reenters handle 14 into an aperture 54 where its opposite end is connected to a tension spring 56 stretched out in cavity 54 and connected at the other end thereof by a pinion or bolt 58.

Drum 50 is connected, as will be better seen in connection with FIG. 4, to a gear 60 which is fastened to a rotatable shaft 62 extending down the interior of shaft housing 18 and is fastened to the drive member 16.

It will be understood that squeezing of movable member 30 with respect to handle members 24 and 26 will cause clockwise rotation of member 40 thus pulling cable 44 to the left, in FIG. 3, so as to rotate drum 50 in a clockwise direction and pull tension spring 56 further to the right in so doing. Rotation of drum 50 will cause rotation of pinion 60 and thus shaft 62 and driving member 16 so as to cause the desired motion for turning the screw members. Upon releasing the squeezing force, spring 56 will pull cable 44 and drum 50 in a counterclockwise direction thus bringing the apparatus back to the position shown in FIG. 3. By a clutch arrangement, described in connection with FIG. 4, releasing of the squeezing force, while rotating drum 50 in the counterclockwise direction, will not result in rotation of pinion 60 or driving member 16 thus eliminating the need to disengage the driving member 16. Further driving of the screw is accomplished by additional squeezings of handle 14 and a large number of rotations are possible without undue fatigue.

Referring to FIG. 4, an interior view of the driving head 12 is shown. As can be seen in FIG. 4, cable 44 on exiting handle 14 is wrapped several times around drum 50 which has on its outer surface grooves such as 70 sized to fit the cable 44.

Drum 50 is connected through a clutch mechanism 74, which may be an RL 040708 overrunning clutch manufactured by the Torrington Co., to central bolt 75 connected to a gear 76 which is adapted to cooperate with pinion 60 which is shown attached to shaft 62 as by a set screw 78. As drum 50 rotates in the driving direction, clutch 74 rotates central bolt 75 and gear 76 so as to drive pinion 60, shaft 62 and driver member 16. When drum 50 turns in the opposite direction, clutch 74 prevents bolt 75, gear 76, pinion 60, shaft 62 and member 16 from turning.

Driving member 16 is shown attachable to shaft housing 18 as by screw threads 86 so that member 16 may be removed and replaced for various applications. Screw threads 86 should be oppositely threaded to prevent unwinding during use.

It is thus seen that squeezing of the movable member 30 results in linear motion of cable 44, pulling drum 50 in the driving direction so that through clutch mechanism 74, driving gear 76, pinion 60, shaft 62 and driving member 16 are rotated in the desired direction. Release of the squeezing force results only in rotation of drum 50 since clutch 74 does not transfer this rotation to the member 16.

Spring biased member 20 is also shown in FIG. 4 having a cup-shaped portion 90 into which a compression spring 92 is positioned. Lower handle member 26 of handle 14 also has a cup-shaped portion 94 into which the other end of spring 92 is positioned. Spring 92 is held in place by a bolt 96 extending from a cup-shaped portion 98 in upper handle member 24 through handle 14 and the center of spring 92. Member 20 has a vertical shaft 100 extending through an aperture 101 in the head 12. The upper end of shaft 100 has an enlarged section 102 which cooperates with a member 104, better seen in FIG. 5, to allow rotation of the shaft housing 18 to various tilt angles. Member 104 has a plurality of crescent-shaped apertures 110 into which the enlarged end portion 102 may fit and lock. By pushing member 20 upwardly against the compression of spring 92, enlarged portion 102 will move out of contact with member 104 to allow rotation of the shaft housing 18 about the axis of bolt 80 so as to bring other crescent shaped apertures 110 into alignment with the enlarged portion 102. When the desired position is reached, member 20 is released and under the action of spring 92 enlarged portion 102 moves into the desired crescent cutout, thus locking it in the desired position. While three such positions have been shown in FIG. 5, it is clear that any number of desired positions may be utilized.

It is therefor seen that I have provided a novel tiltable head driver mechanism in which rotary motion is obtained through squeezing action of the handle through a one-way clutch mechanism that allows rotary motion of the driving member 16 without withdrawing it from the screw it is driving.

If desired, the cable 44 can be wound around drum 50 in the opposite direction so as to create a similar device but with unscrewing capabilities.

Although the present invention has been described with reference to preferred embodiments, workers skilled in the art will recognize that changes may be made in form and detail without departing from the spirit and scope of the invention.

What is claimed is:

1. Squeeze motion to rotary motion driver apparatus for driving an output member comprising:

drum means rotatable about a first axis;

driver means for driving the output member in a first direction about a second axis perpendicular to the first axis;

clutch means connected between the driver means and the drum means to provide rotation of the driver means in the first direction upon rotation of the drum means in a predetermined direction;

first and second lever members squeezable from a first to a second position;

positioning means having an at least partly circular surface connected to the first lever member so as to be rotatable about a third axis parallel to the first axis, squeezing of the first and second lever members causing motion of the circular surface around the third axis; and cable means connected to the positioning means so as to extend along a first path from a position tangential to the circular surface to the drum means and wound around the drum means so that upon squeezing the first and second lever members from the first to the second position, the motion of the circular surface around the third axis pulls the cable means along the circular surface and the cable means, staying tangential to the circular surface and moving in the first path, operates to pull the cable around the drum means and thereby cause rotation of the drum means in the predetermined direction.

* * * * *